US009924770B2

(12) United States Patent
Bourgeois et al.

(10) Patent No.: US 9,924,770 B2
(45) Date of Patent: Mar. 27, 2018

(54) MULTIFUNCTIONAL CARRYING DEVICE

(71) Applicant: MU GENERATION LIMITED, Tsuen Wan (HK)

(72) Inventors: Michael L. Jean-Raymond Bourgeois, Tsuen Wan (HK); Cheuk Yiu Wong, Tsuen Wan (HK)

(73) Assignee: MU GENERATION LIMITED, Hong Kong (CN)

( * ) Notice: Subject to any disclaimer, the term of this patent is extended or adjusted under 35 U.S.C. 154(b) by 152 days.

(21) Appl. No.: 14/678,249

(22) Filed: Apr. 3, 2015

(65) Prior Publication Data

US 2016/0198828 A1 Jul. 14, 2016

(30) Foreign Application Priority Data

Jan. 8, 2015 (HK) ..... 15100193

(51) Int. Cl.

| | |
|---|---|
| ***A45C 15/00*** | (2006.01) |
| ***A45C 13/10*** | (2006.01) |
| ***A45C 13/26*** | (2006.01) |
| ***A45C 13/30*** | (2006.01) |
| ***A45C 13/38*** | (2006.01) |
| ***A45C 5/14*** | (2006.01) |
| ***A45C 7/00*** | (2006.01) |

(52) U.S. Cl.

CPC ..... *A45C 13/1084* (2013.01); *A45C 5/14* (2013.01); *A45C 5/143* (2013.01); *A45C 7/0045* (2013.01); *A45C 7/0086* (2013.01); *A45C 13/26* (2013.01); *A45C 13/262* (2013.01); *A45C 13/30* (2013.01); *A45C 13/385* (2013.01); *A45C 15/00* (2013.01); *A45C 2013/306* (2013.01)

(58) Field of Classification Search

CPC ..... A45C 13/1084; A45C 5/14; A45C 5/143; A45C 7/0086; A45C 13/26; A45C 13/262; A45C 13/30; A45C 13/385; A45C 15/00; A45C 2013/306

See application file for complete search history.

(56) References Cited

U.S. PATENT DOCUMENTS 3,696,850 A * 10/1972 Rosenblum ..... A45C 7/0086 190/108
4,762,257 A * 8/1988 Spillers ..... A62B 35/0037 224/250
5,604,958 A * 2/1997 Anscher ..... A45C 7/0086 224/197

(Continued)

*Primary Examiner* — Tri Mai
(74) *Attorney, Agent, or Firm* — Muncy, Geissler, Olds & Lowe, P.C.

(57) ABSTRACT

The present invention discloses a multifunctional carrying device comprising a female connecting member and a male connecting member which the female connecting member and the male connecting member are connected in a snap-in manner; either the male connecting member or the female connecting member being fixed on a bag. The multifunctional carrying device of this invention can be used on both horizontal direction and vertical direction, not just simply adding a bag, but it could change from one application to another application, so as to increase the utility. This invention could be dismantled and saves space, basically it will not increase the weight of the bag and convenient in using.

8 Claims, 21 Drawing Sheets

(56) References Cited

U.S. PATENT DOCUMENTS

| | | | | | |
|---|---|---|---|---|---|
| 5,829,559 | A * | 11/1998 | Nordstrom | A45C 5/14 | 190/102 |
| 6,012,729 | A * | 1/2000 | Lin | B62B 1/125 | 280/37 |
| 6,965,231 | B1 * | 11/2005 | Cinoglu | A61B 5/0555 | 324/300 |
| 2002/0070087 | A1 * | 6/2002 | Lee | A45C 13/262 | 190/115 |

* cited by examiner

MULTIFUNCTIONAL CARRYING DEVICE

TECHNICAL FIELD OF THE INVENTION

The present invention relates to a fixed device, and more particularly, to a multifunctional carrying device.

BACKGROUND OF THE INVENTION

Bag normally means a container of things, due to the role of bags in travel, as well as the use of bags in fashion activities, leisure sports or business life, so the application of bag is very wide.

So far, products of many companies enable bags to be carried in horizontal direction or vertical direction, which is convenient to the consumers, but they also add a handle on the bag, such as haversack or luggage case. From the perspective of aesthetics, adding a handle usually makes it feel bulky and imbalanced, so some companies hide the added handle, or add two handles on one single bag, those methods are still impractical. From a practical view, adding two handles on one bag is a limited concept, it is not working or inconvenient when in use, because the opening of the bag can only be on one direction. Besides, pulling rod system couldn't work on two directions. The wheels of bag will be seen during horizontal movement.

A recent trend is to add one bag onto another bag, in this way, traveler feel more comfortable in carrying heavier things with a plastic clamp being used. However the plastic clamp often conflicts with the opening of the bag and causes inconvenience when using. Likewise a metal hook also has the same problem.

Some bags recently are added with net pocket, which is unstable and can carry light and small products only.

SUMMARY OF THE INVENTION

The technical issue to be solved by this invention is to provide a multifunctional carrying device, which can be dismantled and save space, basically not increase the weight of the bag, and very convenient in using.

This invention is to solve the aforesaid technical issues through the following technical solutions:

A multifunctional carrying device, said device comprising:

a female connecting member and a male connecting member in which the female connecting member and the male connecting member are connected in a snap-in manner; and either the male connecting member or the female connecting member being fixed on a bag.

In one embodiment of the multifunctional carrying device of the invention, either the female connecting member or the male connecting member is attached with an external accessory.

Preferably, the external accessory is a pull rod.

Preferably, the external accessory is a strap.

Preferably, the external accessory is a ring-pull.

Preferably, the external accessory mentioned is a cord-pull.

Preferably, the external accessory mentioned is an idler wheel.

In another embodiment of the multifunctional carrying device of the invention, the female connecting member comprises a handle, a panel used for automatic lock catch, a connection base having a groove on the bottom thereof, a button; in which the panel used for automatic lock catch is installed between the handle and the connection base, the connection base is snapped into the handle, and the button is disposed on the connection base.

In another embodiment of the multifunctional carrying device of the invention, the male connecting member comprises a panel, an automatic fastening member, a fixing base, in which one end of the automatic fastening member is snapped into the fixing base and the other end thereof penetrates through the panel to snap into the groove.

In another embodiment of the multifunctional carrying device of the invention, the female connecting member and the male connecting member are located on two bags or suitcases respectively so as to connect these two bags or suitcases.

In light of the above, the present invention may bring many advantages and benefits, for example, this invention can be used in both horizontal and vertical direction, not just simply adding another bag, but it could change from one application to another application, so as to increase the utility. This invention could be dismantled and saves space, basically it will not increase the weight of the bag and is convenient to use.

BRIEF DESCRIPTION OF THE DRAWINGS

The features of the present invention are presented by the accompanying drawings. The invention, together with the advantages thereof may be best understood by reference to the following description taken in conjunction with the accompany drawings, wherein like reference signs identify like elements, and wherein.

DETAILED DESCRIPTION OF THE INVENTION

The structure of the present invention will be explained in detail with reference to the accompany drawings. The description and explanatory embodiments herein are merely used to elaborate on the present invention, not to limit the invention.

Figure 1:
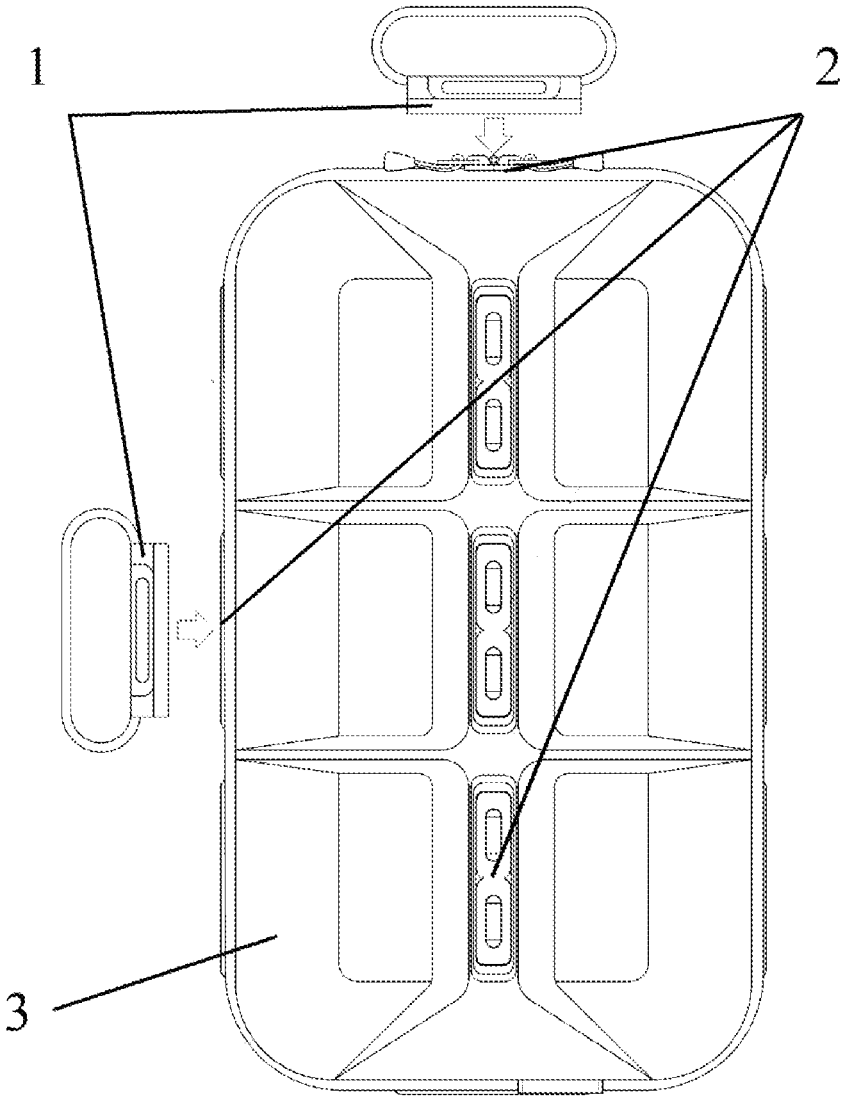
FIG. 1 is a schematic view of this invention after dismantling the multifunctional carrying device.
Figure 2:
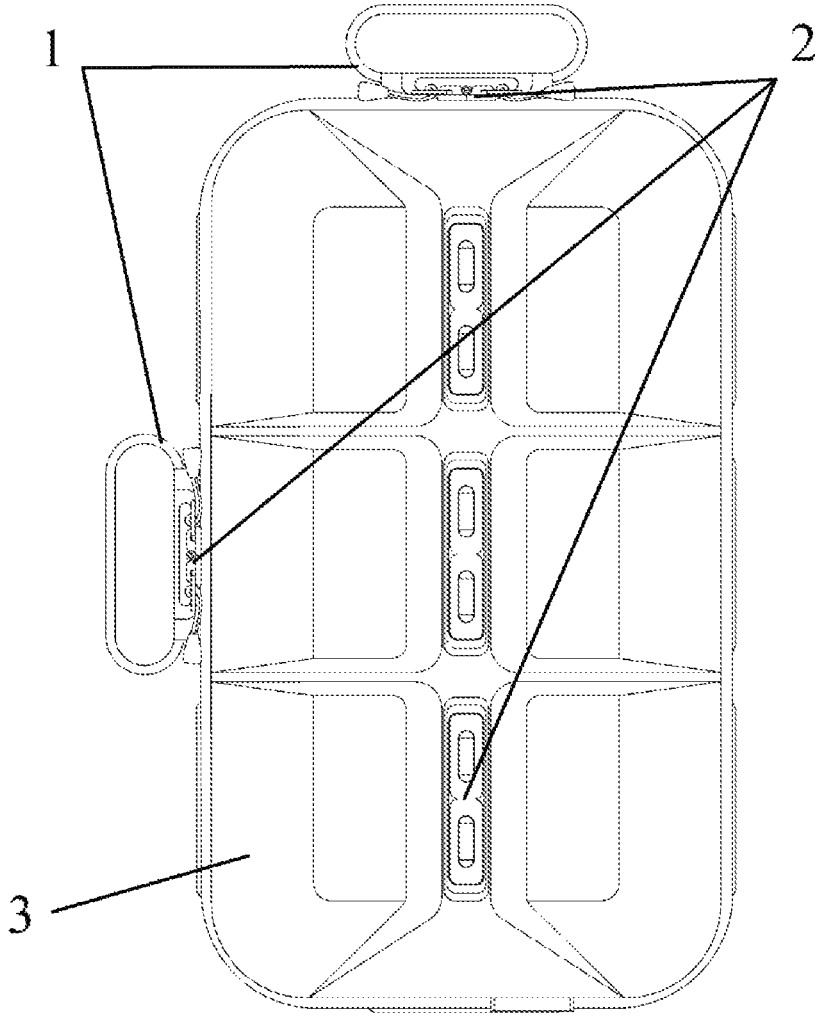
FIG. 2 is a schematic view of this invention after assembling the multifunctional carrying device.

As shown in FIG. 1 and FIG. 2, a multifunctional carrying device of this invention includes a female connecting member 1 and a male connecting member 2. The female connecting member 1 is connected with the male connecting member 2 in a snap-in manner, and the male connecting member 2 is fixed on a bag 3. The female connecting member 1 may connect with the external accessories such as a handle, an idler wheel, a pull rod, etc. The female connecting member 1 has a hole that is convenient for hand holding. Of course, the female connecting member 1 can also be fixed on the bag.

Figure 3:
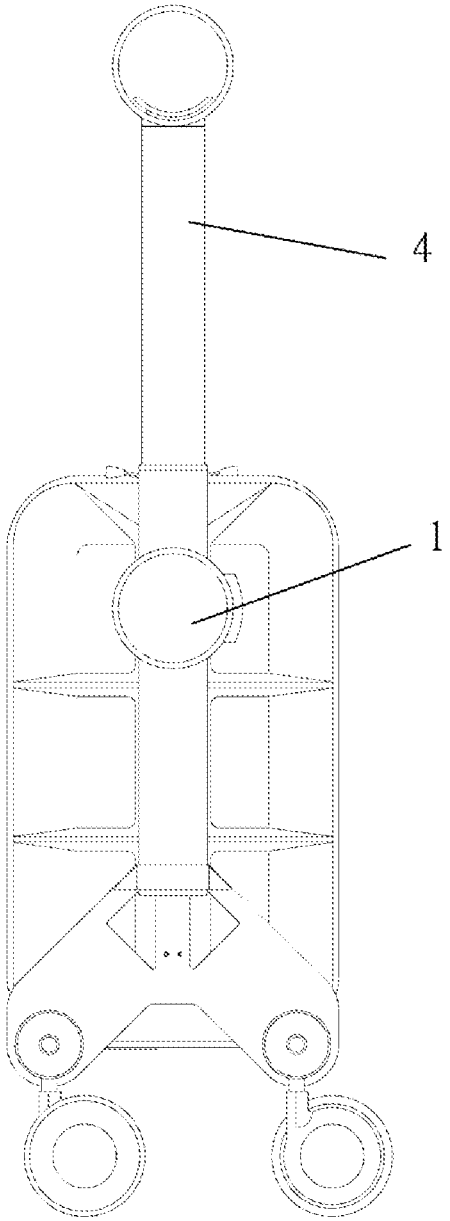
FIG. 3 is a schematic view of this invention with the multifunctional carrying device connecting with the pull rod.

As demonstrated in FIG. 3, the female connecting member 1 is connected with the pull rod 4, which is convenient for pulling.

Figure 4:
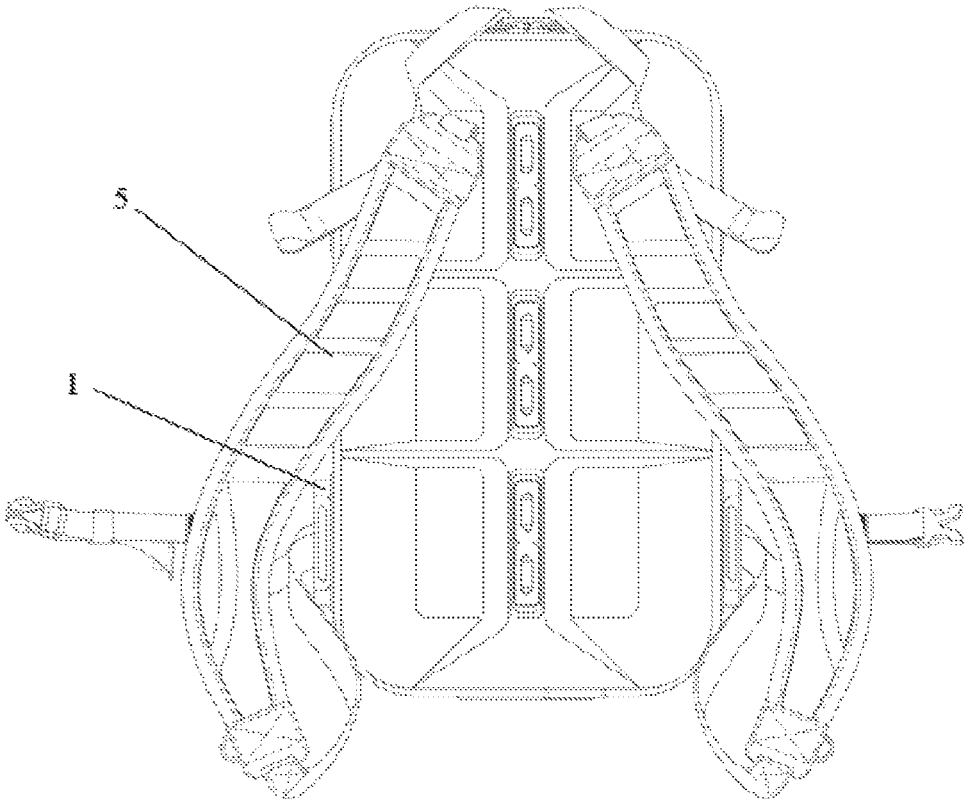
FIG. 4 is a schematic view of this invention with the multifunctional carrying device connecting with the straps.

As demonstrated in FIG. 4, the female connecting member 1 is connected with the strap 5, which is convenient for shouldering.

Figure 5:
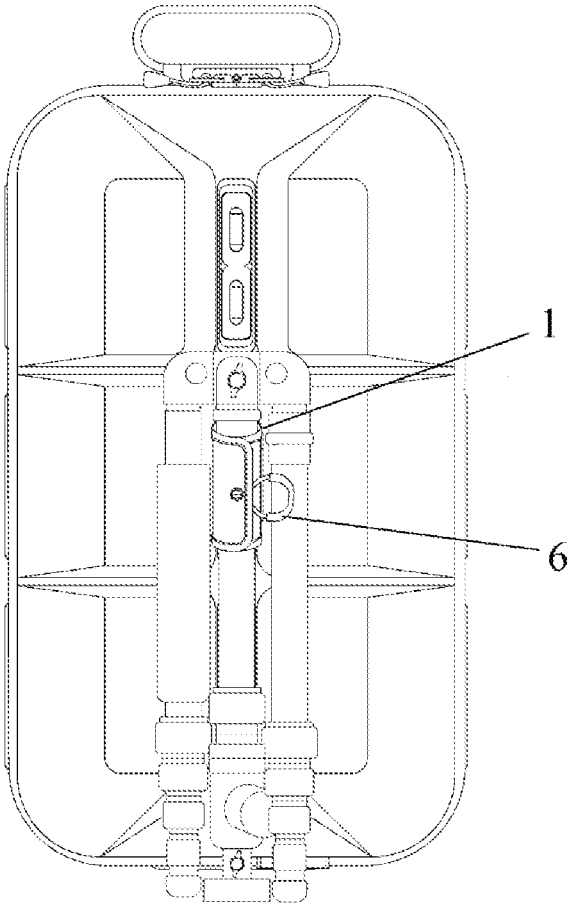
FIG. 5 is a schematic view of this invention with the multifunctional carrying device connecting with the ring-pull.

As demonstrated in FIG. 5, the female connecting member 1 is connected with the ring-pull 6, which is convenient for pulling.

Figure 6:
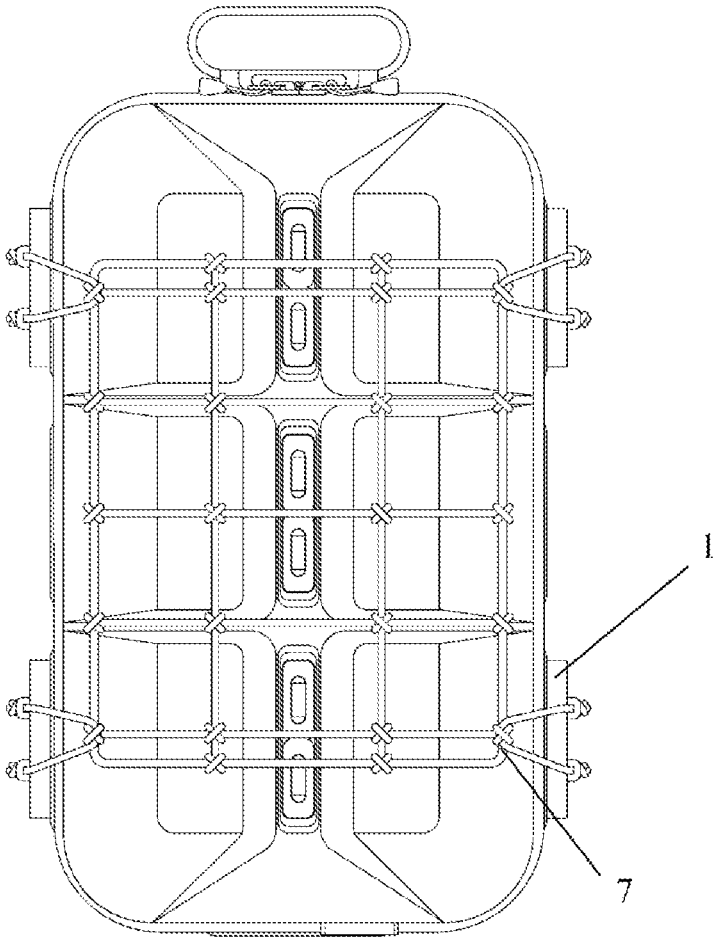
FIG. 6 is a schematic view of this invention with the multifunctional carrying device connecting with the cord-pull.

As demonstrated in FIG. 6, the female connecting member 1 is connected with the cord-pull 7, which is convenient for pulling.

Figure 7:
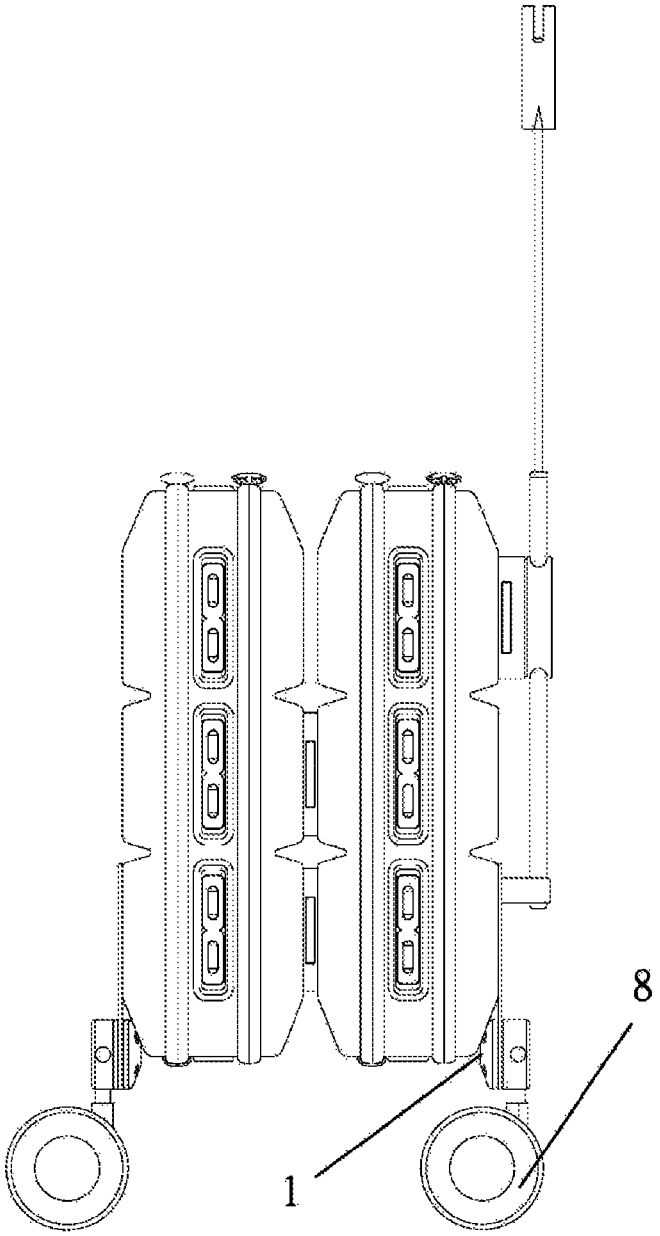
FIG. 7 is a schematic view of this invention with the multifunctional carrying device connecting with the idler wheel.

As demonstrated in FIG. 7, the female connecting member 1 is connected with the idler wheel 8, which is convenient for rolling.

Figure 8:
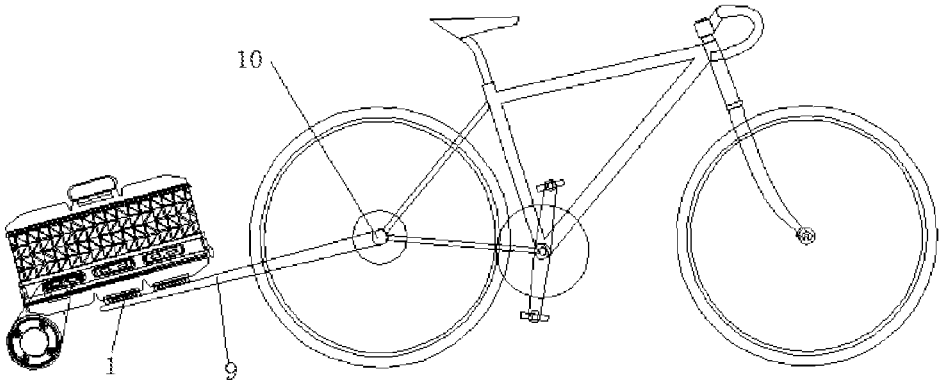
FIG. 8 is a schematic view of this invention with the multifunctional carrying device matching the bicycle.

As demonstrated in FIG. 8, the female connecting member 1 is attached to a bicycle 10 through a connecting rod 9, which is convenient for rolling.

Figure 9:
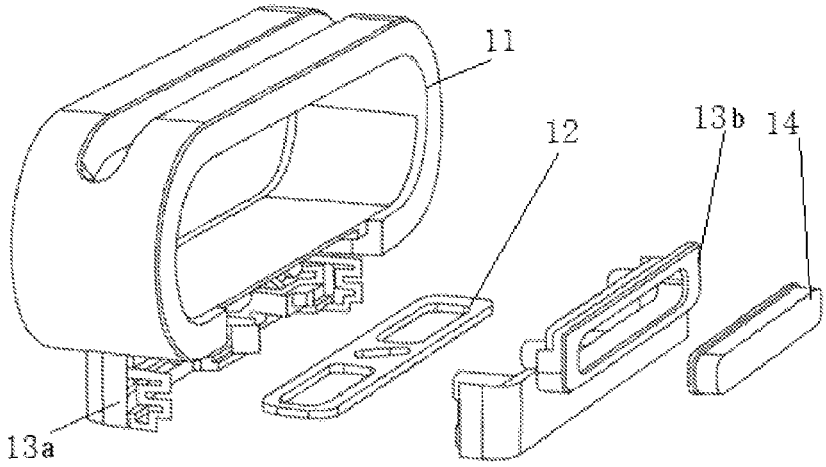
FIG. 9 is a schematic view of this invention with the exploded female connecting member.
Figure 10:
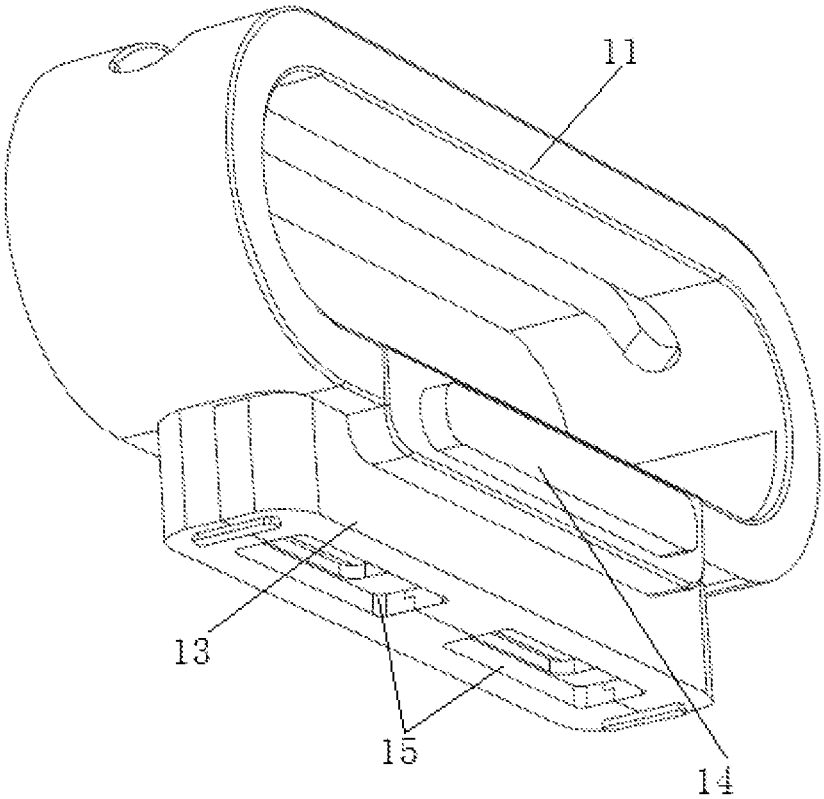
FIG. 10 is a schematic view of this invention with the assembled female connecting member.

As demonstrated in FIG. 9 and FIG. 10, the female connecting member 1 is fixed with a handle 11 and includes a panel used for automatic lock catch 12, a connection base 13 comprising a left half 13*a*, a right have 13*b* and a groove 15 on the bottom thereof, a button 14; in which the panel used for automatic lock catch 12 is installed between the left half 13*a* and the right half 13*b* of the connection base 13, where the right half 13*b* of the connection base 13 is snapped into the left half 13*a* of the connection base 13, and the button 14 is disposed on the connection base 13.

Figure 11:
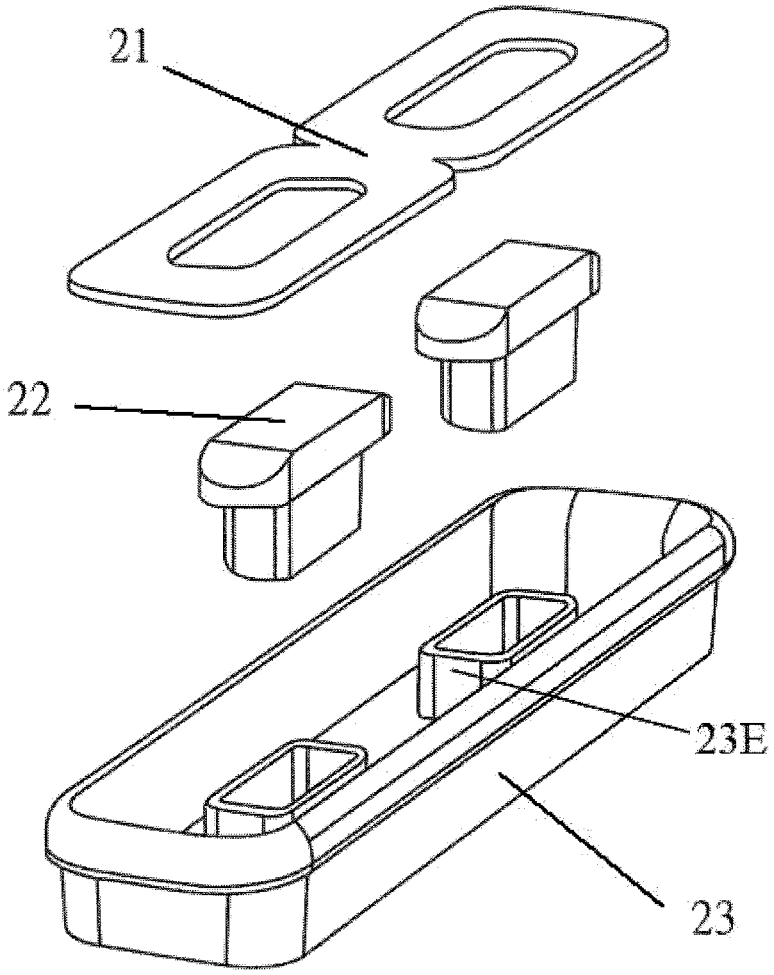
FIG. 11 is a schematic view of this invention with the exploded male connecting member.
Figure 12:
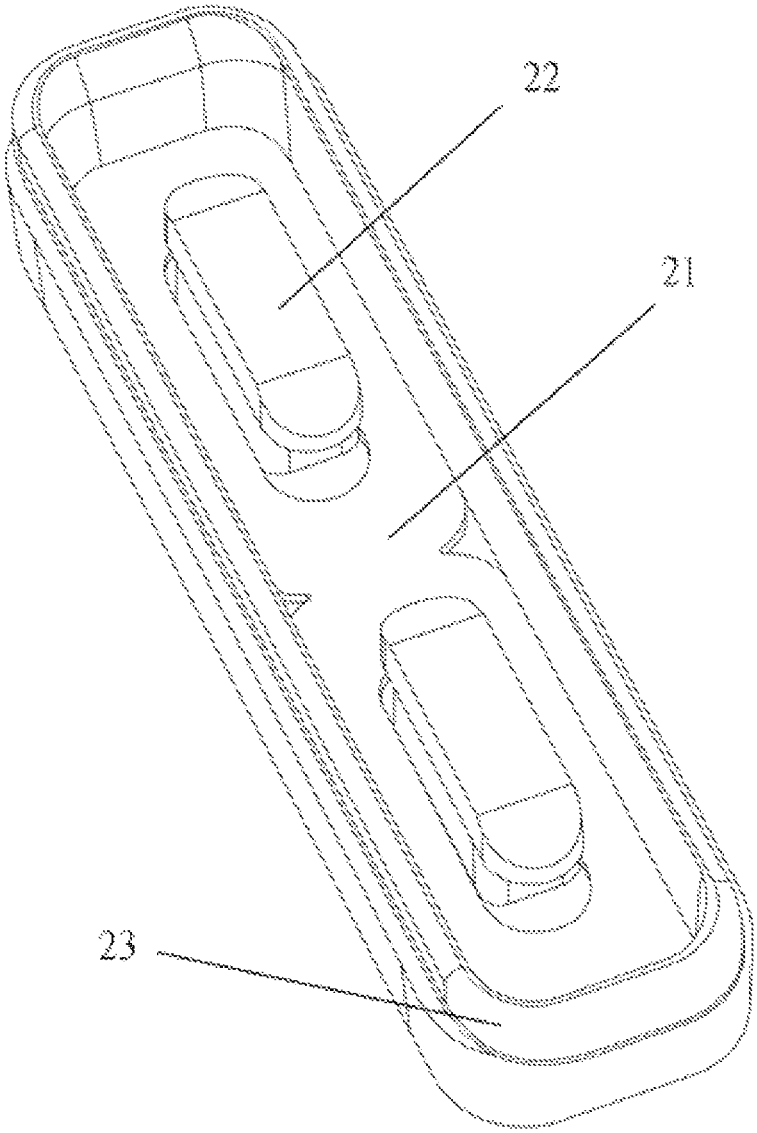
FIG. 12 is a schematic view of this invention with the assembled male connecting member.

As demonstrated in FIG. 11 and FIG. 12, the male connecting member 2 includes, a fixing base 23 comprising two entrenchments 23E, two automatic fastening members 22, and a decorative plate 21. The automatic fastening members are framed into the entrenchments provided by the base 23 and the decorative plate is disposed on the fixing base. The fixing base 23 is installed either on the device or on the accessory.

Figure 13:
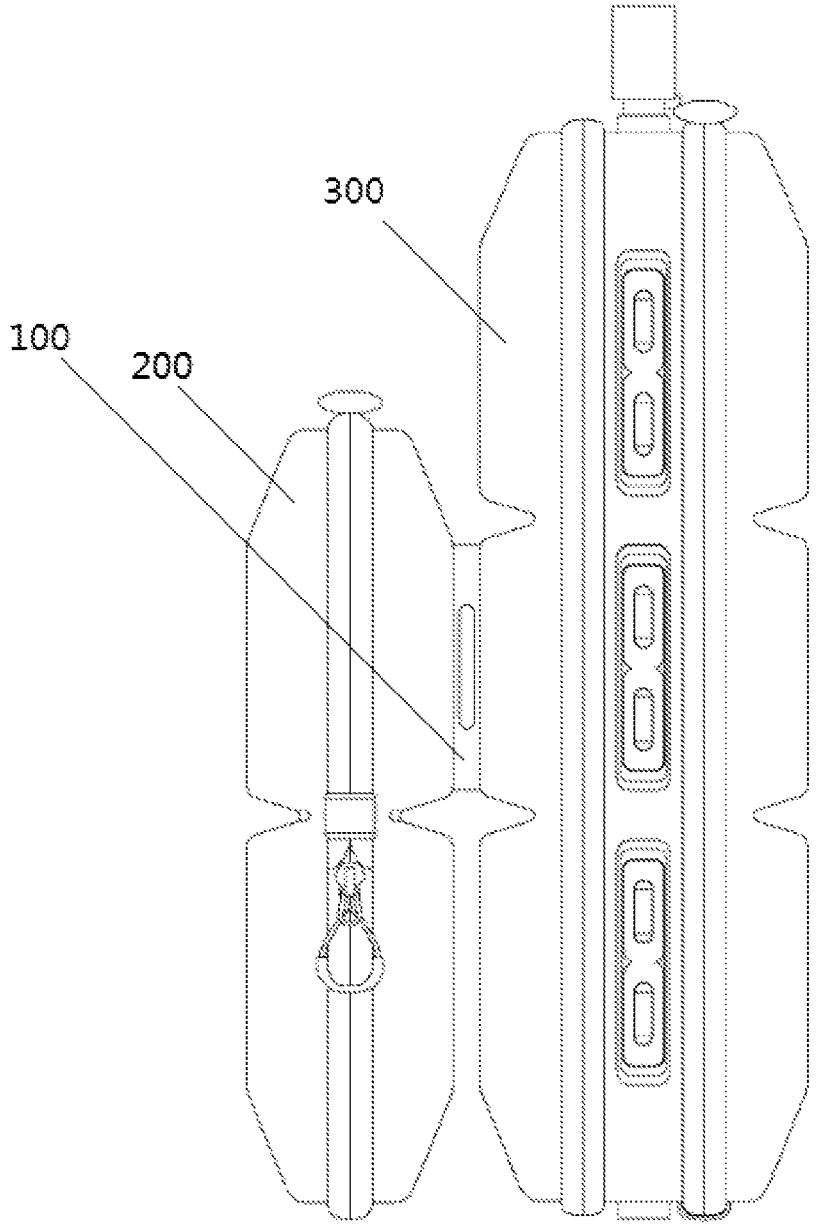
FIG. 13 is a schematic view of this invention showing two bags connected together.

As demonstrated in FIG. 13, in one example of this invention, the female connecting member and male connecting member of the multifunctional carrying device 100 are respectively located on the two suitcases 200 and 300, and the two have been combined accordingly.

Figure 14A:
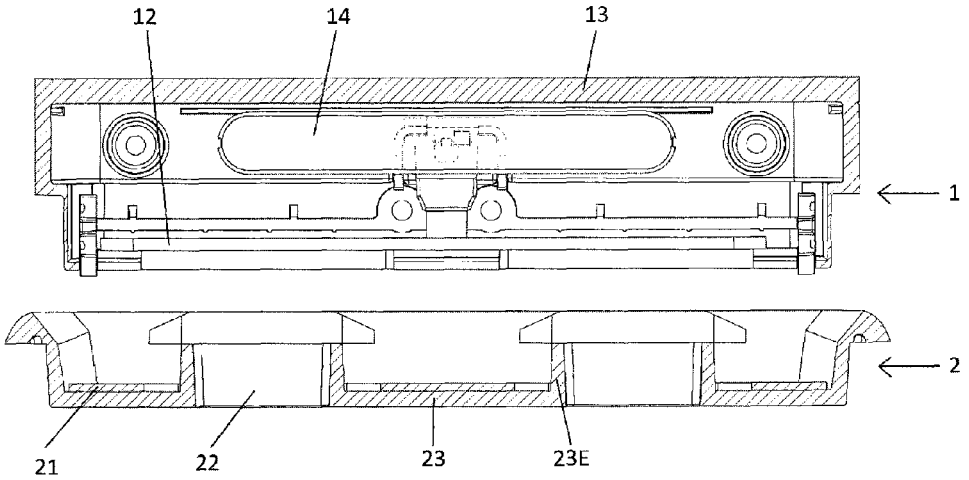
FIGS. 14A, 14B, 14C and 14D are partial sectional views of this invention showing snap attachment between the male connecting member 2 and female connecting member 1.
Figure 15A:
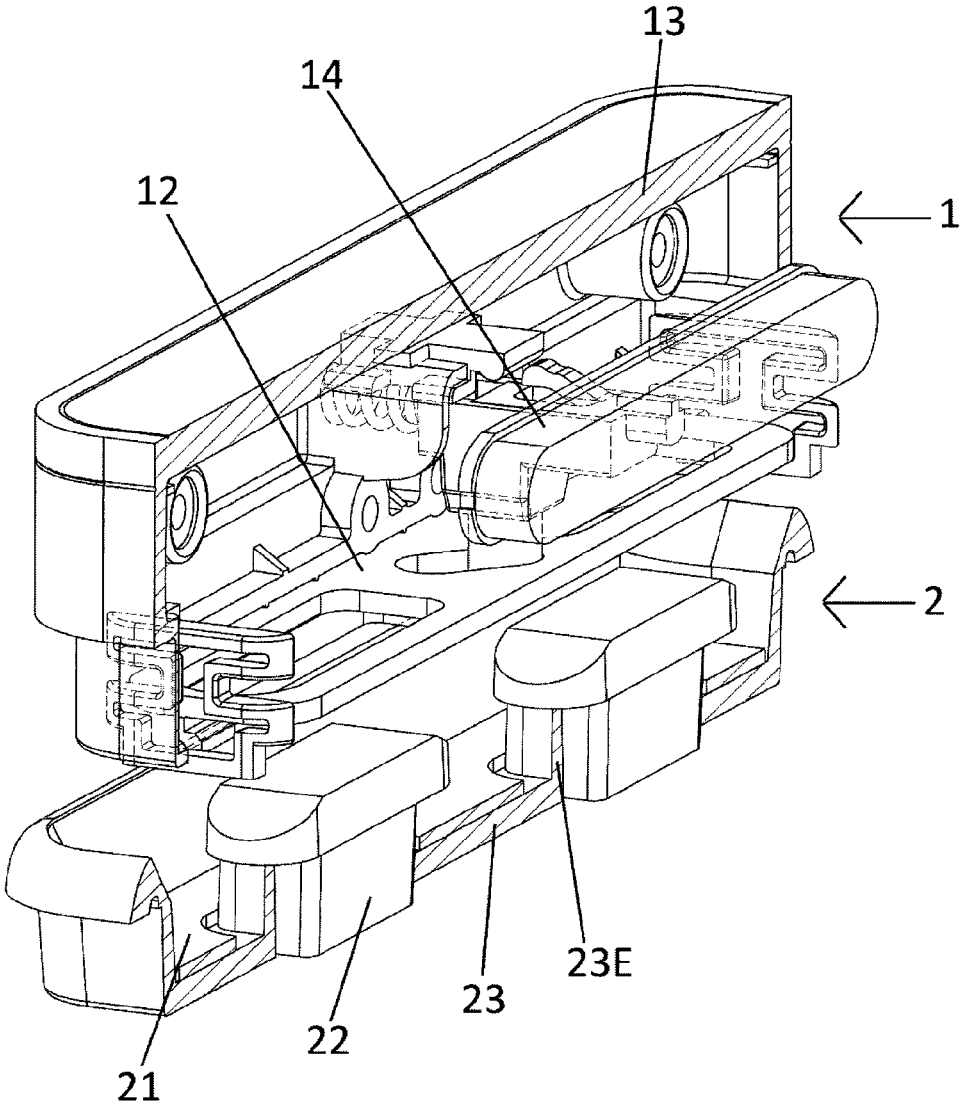
FIGS. 15A, 15B, 15C and 15D are perspective partial sectional views of this invention showing the snap attachment between the male connecting member 2 and female connecting member 1.

As demonstrated in FIG. 14A and FIG. 15A, the panel 12 used for automatic lock catch is, in its initial position, uncentered in the female connecting member 1, and therefore the position in between the two slots (holes) of the panel 12 and the two grooves 15 of the female connecting member 1 are not matching in position.

Figure 14B:
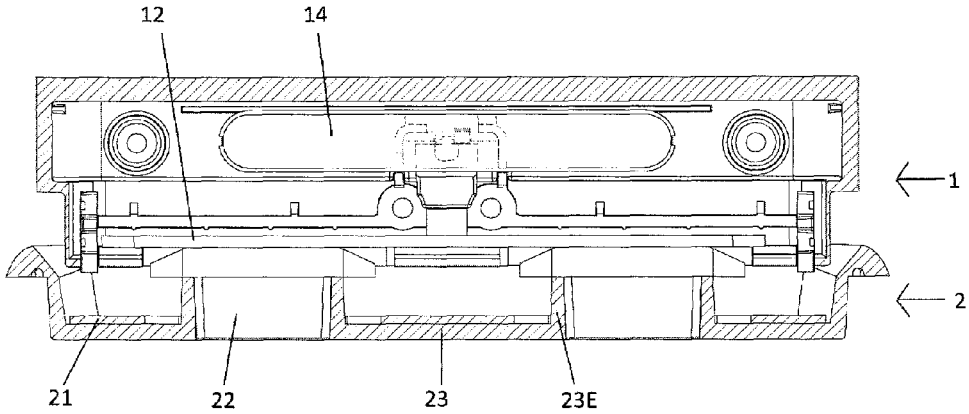
Figure 15B:
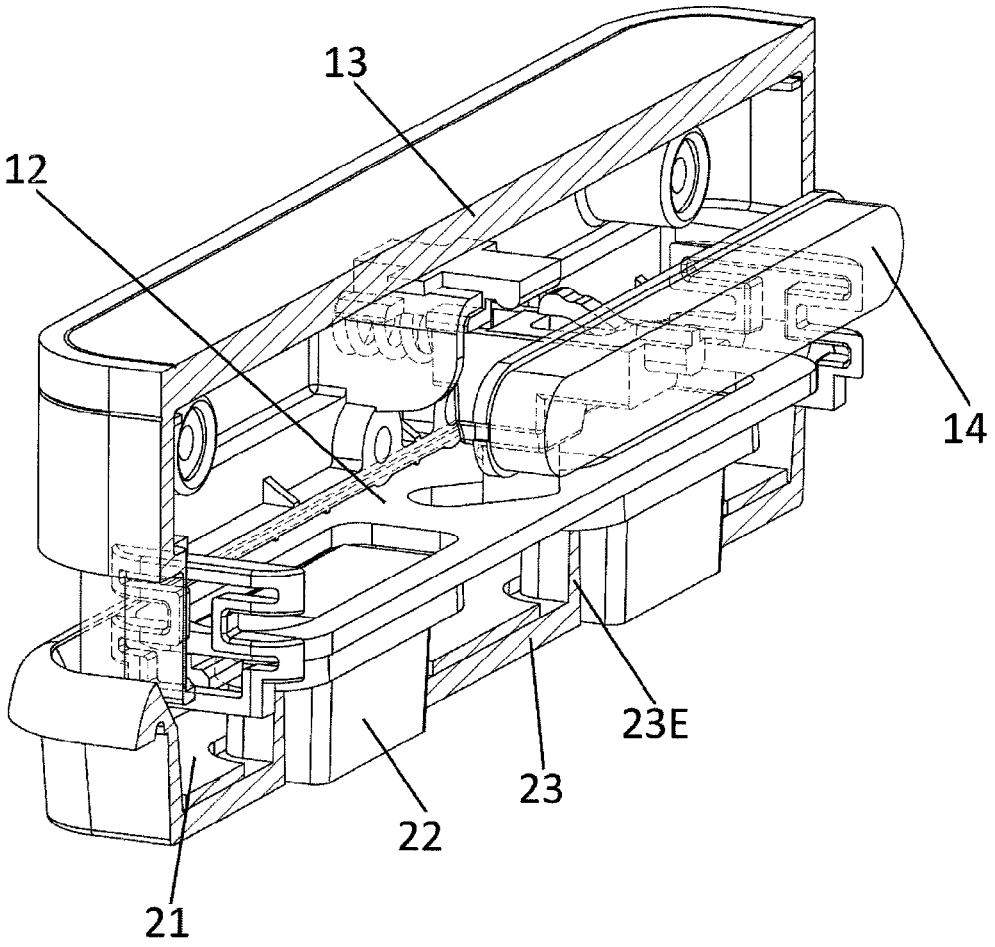

As demonstrated in FIG. 14B and FIG. 15B, when the female connecting member 1 is guided onto the base 23 of the male connecting member 2, the two grooves 15 of the female connecting member 1 and the two fastening members 22 of the male connecting member 2 are perfectly aligned and well positioned. However, the two slots of the panel 12 inside the female connecting member 1 are not aligned with either the grooves 15 of the female connecting member 1, or with the fastening members 22 of the male connecting member 2.

Figure 14C:
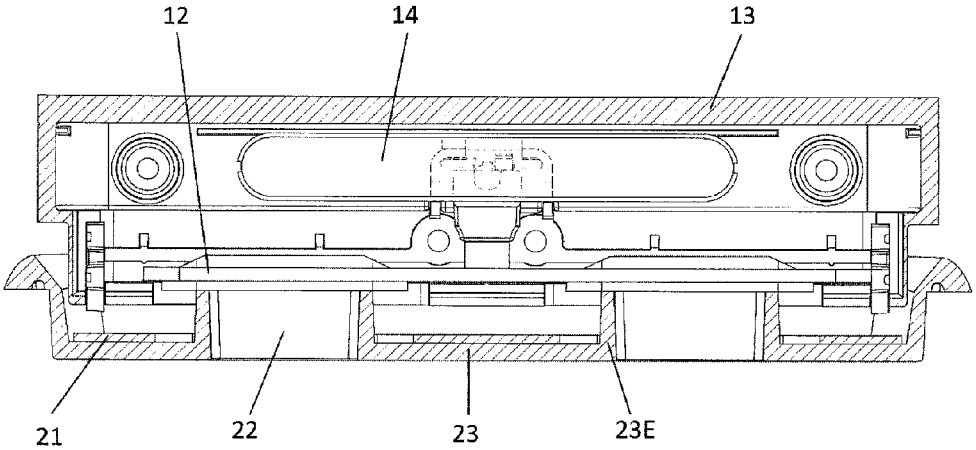
Figure 14D:
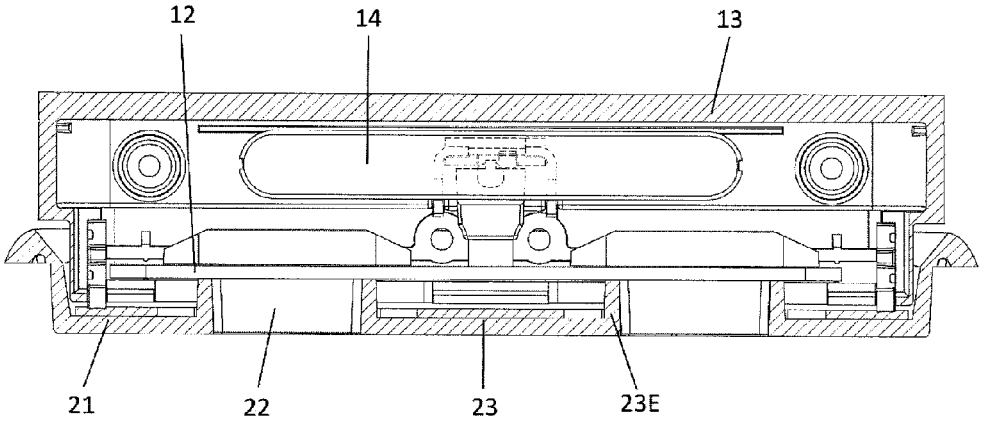
Figure 14E:
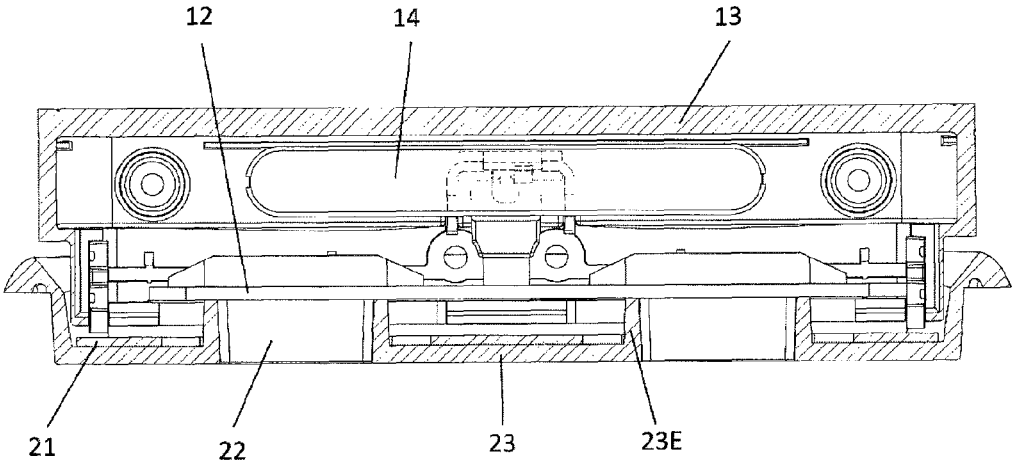
FIG. 14E is partial sectional view of this invention showing the release of the automatic lock catch 12 from the automatic fastening members 22, while the button 14 is pressed manually.
Figure 15C:
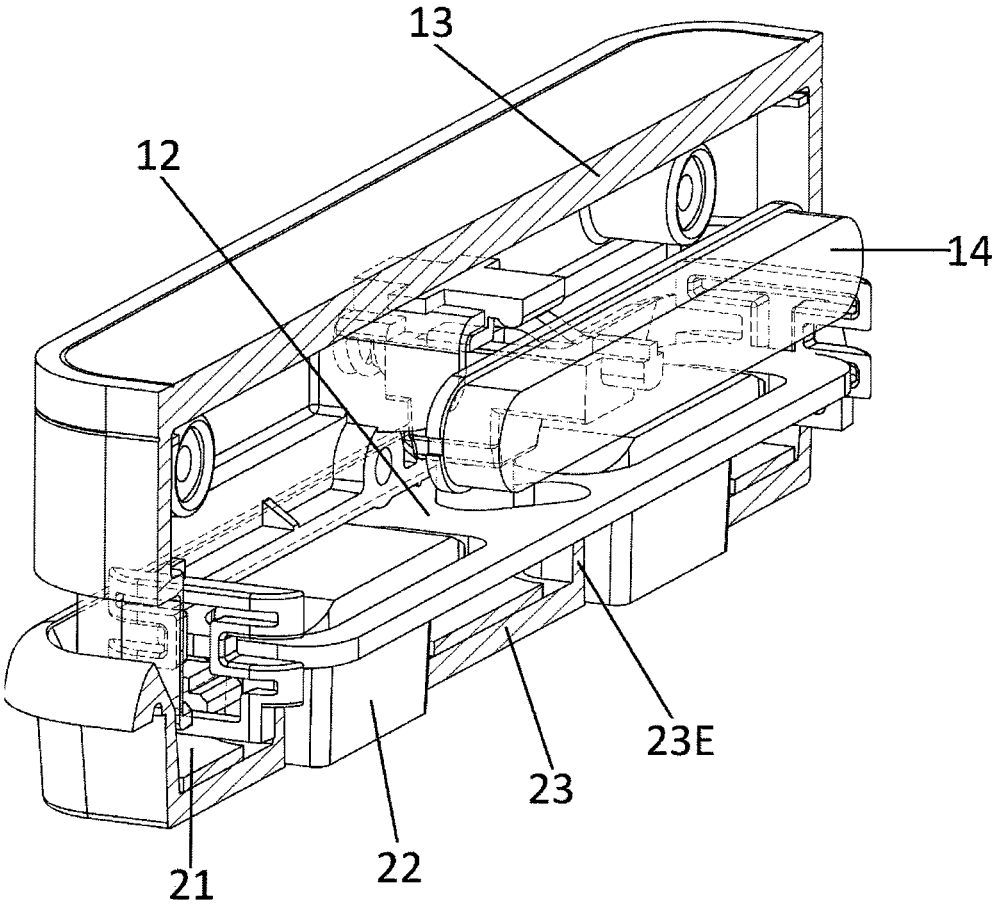
Figure 15D:
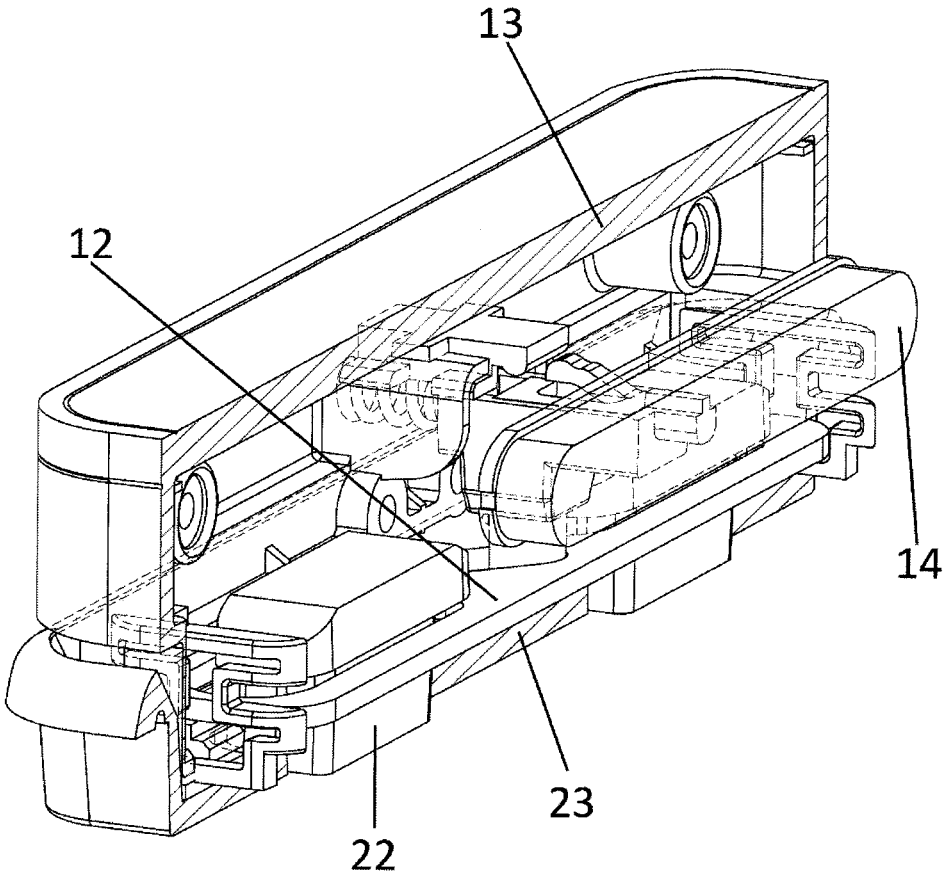
Figure 15E:
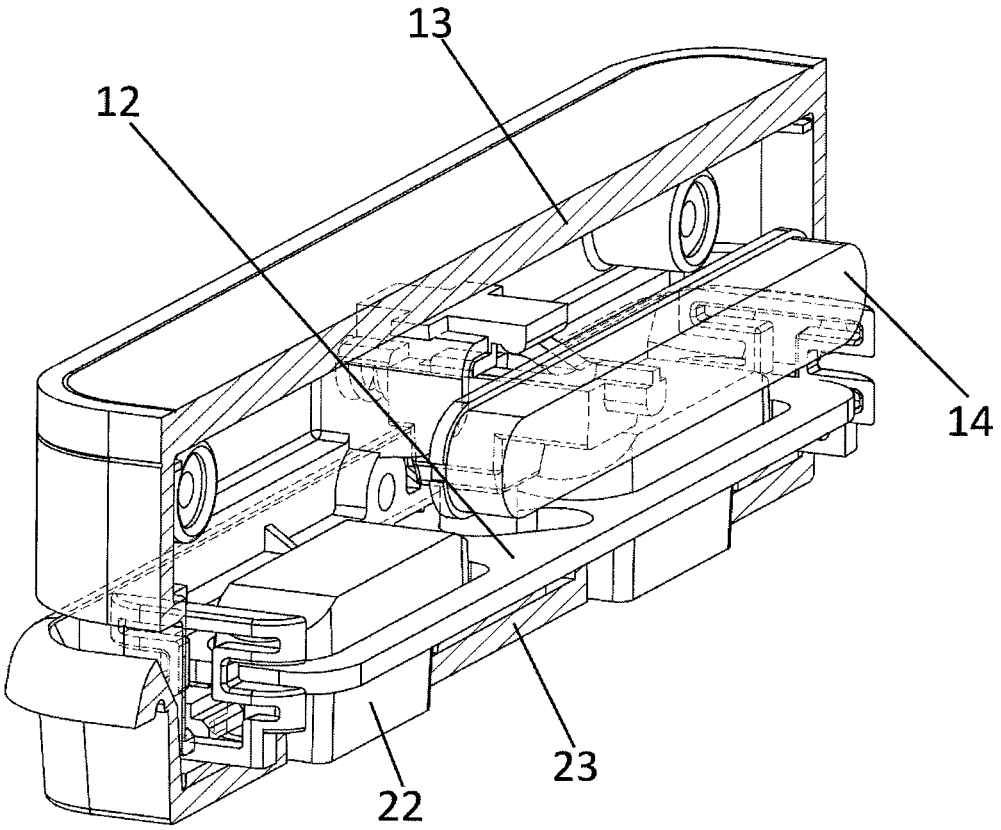
FIG. 15E is perspective partial sectional view of this invention showing the release of the automatic lock catch 12 from the fastening members 22, while the button 14 is pressed manually.
Figure 16A:
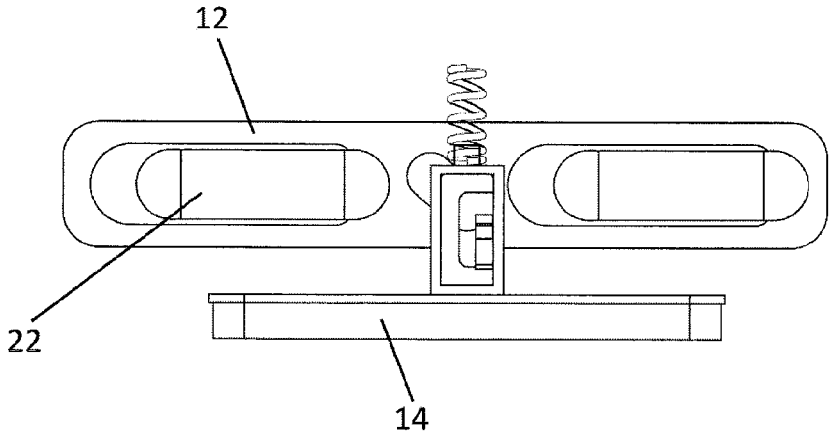
FIGS. 16A and 16B are simplified top views of this invention showing the release of the automatic lock catch 12 from the automatic fastening members 22.
Figure 16B:
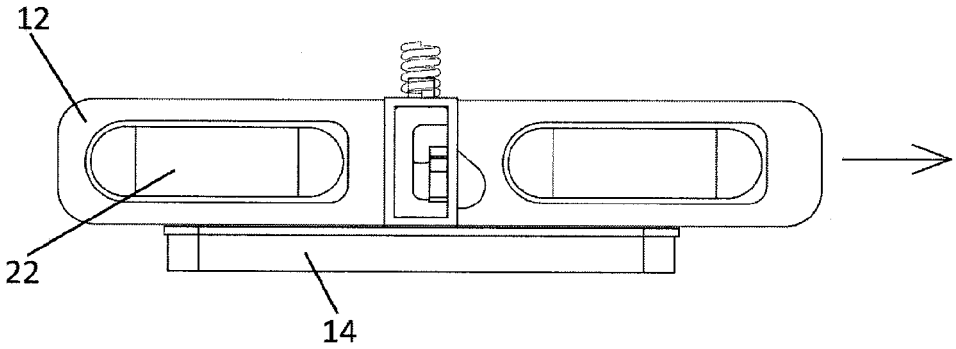

As demonstrated in FIG. 14C and FIG. 15C, when the user snaps the female connecting member 1 into the male connecting member 2, the manual force will make the panel used for automatic lock catch 12 slide at the same time, in the direction as shown by the arrows in respective figures, both forward horizontally and downward vertically along the sloped surfaces of the automatic fastening members 22. Then, as demonstrated in FIG. 14D and FIG. 15D, the automatic lock catch 12 will slide back, in the direction as shown by the arrows in respective figures, backward horizontally to its initial position but beneath the automatic fastening members 22, and eventually be clawed by the automatic fastening members 22 from beneath.

As demonstrated in FIG. 14E, FIG. 15E, FIG. 16A and FIG. 16B, when the button 14 is pushed to release the connection of the female connecting member 1, the panel used for automatic lock catch 12 will slide, in the direction as shown by the arrows in respective figures, forward horizontally from beneath the automatic fastening members 22, and then be pulled out by manual force.

The multifunctional carrying device of this invention can be operated as follows: when in use, the female connecting member 1 can be snapped into the male connecting member 2, and the female connecting member 1 is fixed with the accessories such as the handle, the idler wheel, the pull rod, etc; when not in use, the female connecting member 1 can be detached from the male connecting member 2, in which the female connecting member 1 is detached from the accessories such as the handle, the idler wheel, the pull rod, etc. This invention can be used in both horizontal and vertical direction, not just simply adding a bag, but it could change from one application to another application, so as to increase the utility. This invention could be dismantled and save space, basically it will not increase the weight of bag and is very convenient to use.

It will be obvious to those skilled in the art that various changes and modifications can be made without departing from the true spirit and scope of the invention. However, it should be appreciated that all the embodiments of the present invention described above are illustrative only, and all the changes and modifications made by those skilled in the art are covered by the appended claims.

What is claimed is:

1. A multifunctional carrying device, said device comprising:

a plurality of connections; and each of the plurality of connections comprising a female connecting member and a male connecting member in which the female connecting member and the male connecting member are connected, wherein the female connecting member comprises a panel for an automatic lock catch, a connection base comprising a left half, a right half, two grooves on a bottom thereof, and a button disposed on either the left half or the right half, the panel being installed in the connection base between the left half and the right half, wherein the male connecting member comprises a fixing base comprising two entrenchments, two automatic fastening members, and a decorative plate; the decorative plate being disposed on the fixing base and the two automatic fastening members being framed into the two entrenchments, wherein the male connecting member or the female connecting member is fixed on a bag, wherein the female connecting member or the male connecting member is optionally attached with an external accessory, wherein each of the plurality of connections is optionally attached with an external accessory, which is the same or different, and wherein the bag has a horizontal axis and a vertical axis and the male connecting member or the female connecting member is fixed on the bag.

2. The multifunctional carrying device according to claim 1, wherein at least one of the female connecting members or at least one of the male connecting members is attached with an external accessory.

3. The multifunctional carrying device according to claim 2, wherein the external accessory is a pull rod.

4. The multifunctional carrying device according to claim 2, wherein the external accessory is a strap.

5. The multifunctional carrying device according to claim 2, wherein the external accessory is a ring-pull.

6. The multifunctional carrying device according to claim 2, wherein the external accessory mentioned is a cord-pull.

7. The multifunctional carrying device according to claim 2, wherein the external accessory mentioned is an idler wheel.

8. The multifunctional carrying device according to claim 1, wherein the female connecting member and the male connecting member are located on two bags or suitcases respectively so as to connect these two bags or suitcases.

* * * * *